US007355515B2

(12) United States Patent
Lee et al.

(10) Patent No.: US 7,355,515 B2
(45) Date of Patent: Apr. 8, 2008

(54) MAGNETIC SECURITY DEVICE FOR SECURING DOORS

(75) Inventors: Robert E Lee, Garden City, NY (US); Kenneth G Eskildsen, Great Neck, NY (US)

(73) Assignee: Honeywell International, Inc., Morristown, NJ (US)

( * ) Notice: Subject to any disclaimer, the term of this patent is extended or adjusted under 35 U.S.C. 154(b) by 217 days.

(21) Appl. No.: 11/233,709

(22) Filed: Sep. 23, 2005

(65) Prior Publication Data

US 2007/0069894 A1 Mar. 29, 2007

(51) Int. Cl.
*E05B 45/06* (2006.01)
*G08B 13/08* (2006.01)

(52) U.S. Cl. ..... 340/542; 340/547

(58) Field of Classification Search ..... 340/686.1, 340/686.6, 547, 542, 545.1, 545.2; 335/216; 70/91–145, 467–489, 149, 150, 151 R
See application file for complete search history.

(56) References Cited

U.S. PATENT DOCUMENTS 3,771,153 A * 11/1973 Byrne ..... 340/547
3,772,669 A * 11/1973 Johnston et al. ..... 327/304
3,975,723 A * 8/1976 Bowling et al. ..... 340/547
4,165,501 A * 8/1979 Bongort et al. ..... 335/206
5,392,025 A * 2/1995 Figh et al. ..... 340/547
5,572,190 A * 11/1996 Ross et al. ..... 340/541
5,668,533 A * 9/1997 Jackson et al. ..... 340/547
6,950,033 B1 * 9/2005 Guyre ..... 340/687
6,963,280 B2 * 11/2005 Eskildsen ..... 340/542
7,049,914 B2 * 5/2006 Lamb et al. ..... 335/216
7,051,560 B2 * 5/2006 Sanchirico et al. ..... 70/92

* cited by examiner

*Primary Examiner*—Benjamin C. Lee
*Assistant Examiner*—Jennifer Mehmood
(74) *Attorney, Agent, or Firm*—Anthony R. Barkume

(57) ABSTRACT

A lock position detection device includes a door locking mechanism, a magnetic field sensor such as a reed switch and a wireless transmitter. A magnet enters proximity of the sensor when the actuator is operated to one position and causes the sensor to output a first signal via the RF transmitter, and exits proximity of the sensor when the actuator is operated to another position and causes the sensor to output a second signal. A magnetic field shield is located with respect to the sensor to prevent a magnetic field from outside the door from being detected by the sensor. The magnet is coupled to the door locking mechanism such that the magnet enters and exits proximity of the sensor at an angle generally perpendicular to the sensor when the actuator is operated between positions, substantially along a line that is offset from a centerline of the reed switch.

15 Claims, 9 Drawing Sheets

MAGNETIC SECURITY DEVICE FOR SECURING DOORS

TECHNICAL FIELD

This invention relates to security systems, and in particular to a security device that operates in conjunction with a lock or deadbolt on an entry door to selectively arm and/or disarm the security system in an automatic manner.

BACKGROUND ART

Alarm systems monitor sensors to determine the presence of people within a protected space. If the alarm system detects a breach of the protected space it will respond based on the state of the system. Possible system states include "disarmed", "armed stay", and "armed away." If the system is disarmed it will not cause an alarm due to a breach of perimeter or interior sensors. If the system is armed stay, it will alarm due to a breach of the perimeter sensors, but not due to a breach the interior sensors. If the system is armed away it will alarm based on a breach of the perimeter or interior sensors. The state of the system is determined by the needs of the occupants of the premises. If all of the occupants are leaving the premises then the system should be armed away. If the occupants will be staying within the premises for an extended period of time then the system should be armed stay. For all other scenarios the system should be disarmed.

Problems arise when the system is not properly armed and disarmed. Typical problems include not disarming the system before the alarm sounds, arming away when occupants plan to stay within the protected space, and not arming the system when the premises are unoccupied. These are user created problems and as such, it is desirable to develop a system that will assist the end user with the arming and disarming operations.

Others have attempted to provide partial improvement by offering security systems that will assist the end user with arming and disarming. One such system, as described in U.S. Pat. No. 6,225,903, is armed and disarmed by the action of the deadbolt on the entry door. A switch is mounted in the doorjamb to detect when the bolt is extended into the jamb, i.e. locked. If the deadbolt is locked and the alarm system does not detect motion within a predetermined exit time, then the system will transition to the armed away state. If motion is detected then it will transition to the armed stay state. If the system is armed and the deadbolt is unlocked, then the system will transition to the disarmed state. A major drawback with this arrangement occurs when the door is forced open (i.e. a "kick-in" by an intruder) and the bolt disengages from the jamb switch without the use of a key. Although this is an unauthorized entry, the alarm system will disarm allowing the perpetrator full access to the premises.

An improvement to the '903 patent was set forth in U.S. patent application Ser. No. 10/462,449, now U.S. Pat. No. 6,963,280, which is owned by the assignee of this application. In that patent, a housing included a lock position detecting switch, adapted to detect the position of a lock mounted on a door as being either locked or unlocked, a door position detecting switch adapted to detect the position of the door as being either open or closed, and processing circuitry adapted to generate a security system disarm signal when (1) the position of the lock has transitioned from a locked state to an unlocked state, (2) the door is closed at the time that a predefined time period has elapsed since the position of the lock transitions from a locked state to an unlocked state, and (3) the door has been opened after that predefined time period has elapsed. The door entry device also has a data transmitter for sending the security system disarm signal to the control panel. An alarm signal is generated and transmitted to the control panel when the door is open at the time that the predefined time period has elapsed since the lock has transitioned to an unlocked state. The control panel prevents the security system from being disarmed when an alarm signal is received unless a user code is entered into the security system.

Although the invention in U.S. Pat. No. 6,963,280 significantly improved upon the prior art by providing protection against kick-in situations, it is nonetheless desired to provide an automatic arming/disarming solution by detecting the position of the doorlock alone, in particular by using a mechanism within or attached to the door itself, rather than the doorjamb as in the prior art patents described above.

Attempts have been made in the past to implement a magnetic sensor such as a reed switch mounted within the locking mechanism of the door, with a magnet mounted on a moving component of the lock mechanism, for sensing when a user has locked the door (and then arm the system) or has unlocked the door (and then disarm the system). These attempts have suffered from poor reliability, such as incorrectly sensing the position of the lock an unacceptable number of times, resulting in inadvertent arming and/or disarming of the system. In addition, it is believed that this type of device would result in poor security since intruders would be able to thwart an armed system by using a magnet on the outside of the door to create a magnetic field and as a result "trick" the mechanism into disarming the system.

The present invention addresses these as well as other problems in the prior art as set forth herein.

DISCLOSURE OF THE INVENTION

In a first major aspect of the present invention, a lock position detection device is adapted to be mounted on a door, for securing entry from an outside region of the door to an inside region of the door. The lock position detection device includes a door locking mechanism having an actuator operable so as to be in a first position or a second position, the first position causing the door locking mechanism to lock the door and the second position causing the door locking mechanism to unlock the door. The device also has a magnetic field detection unit with a magnetic field sensor (such as a reed switch) adapted to output a first signal when the magnetic field sensor detects a magnetic field and a second signal when the magnetic field sensor does not detect a magnetic field, and a wireless transmitter coupled to the magnetic field sensor for transmitting a radio frequency signal based on signals received from the magnetic field sensor. The lock position detection device also has a magnet coupled to the door locking mechanism such that the magnet enters proximity of the magnetic field sensor when the actuator is operated to one of the first position or the second position and causes the magnetic field sensor to output the first signal, and exits proximity of the magnetic field sensor when the actuator is operated to the other of the first position or the second position and causes the magnetic field sensor to output the second signal. The lock position detection device also has a magnetic field shield located with respect to the magnetic field sensor so as to prevent a magnetic field originating from the outside region of the door from being detected by the magnetic field sensor.

For example, the magnetic field shield may be made from a ferrous metal, and it may include an end plate and a plurality of sides attached to the end plate so as to form an open-box or half-cylindrical shape, wherein the end plate is located so as to substantially shield the magnetic field sensor from a magnetic field originating from the outside region of the door.

This first aspect solves the problem of an unauthorized magnetic field originating from the outside region of the door from causing the device from disarming the system. In a second aspect of the invention addressed to the reliability of the device, the magnet is coupled to the door locking mechanism such that the magnet enters proximity of the magnetic field sensor at an angle generally perpendicular to the magnetic field sensor when the actuator is operated to one of the first position or the second position and exits proximity of the magnetic field sensor at an angle generally perpendicular to the magnetic field sensor when the actuator is operated to the other of the first position or the second position. In particular, when a reed switch is employed as the magnetic field sensor, the magnet is located so as to enter and exit proximity of the magnetic field sensor substantially along (but offset from) a centerline of the reed switch.

The lock position detection device of the present invention may take on several functional embodiments, such as a kit for retrofitting a door internally or within a housing that may mounted on the inside region of the door and operate the door lock accordingly. The actuator may operable by entry of a key by a user or by a knob accessible to a user.

The lock position detection switch of this invention sends RF signals to the security system as known in the art, and the control panel of the security system acts on these signals as desired. Thus, when the control panel receives a "door locked" signal from the door, it may be programmed to arm the system, and when the control panel receives a "door unlocked" signal from the door, it may be programmed to disarm the system.

BEST MODE FOR CARRYING OUT THE INVENTION

Figure 1:
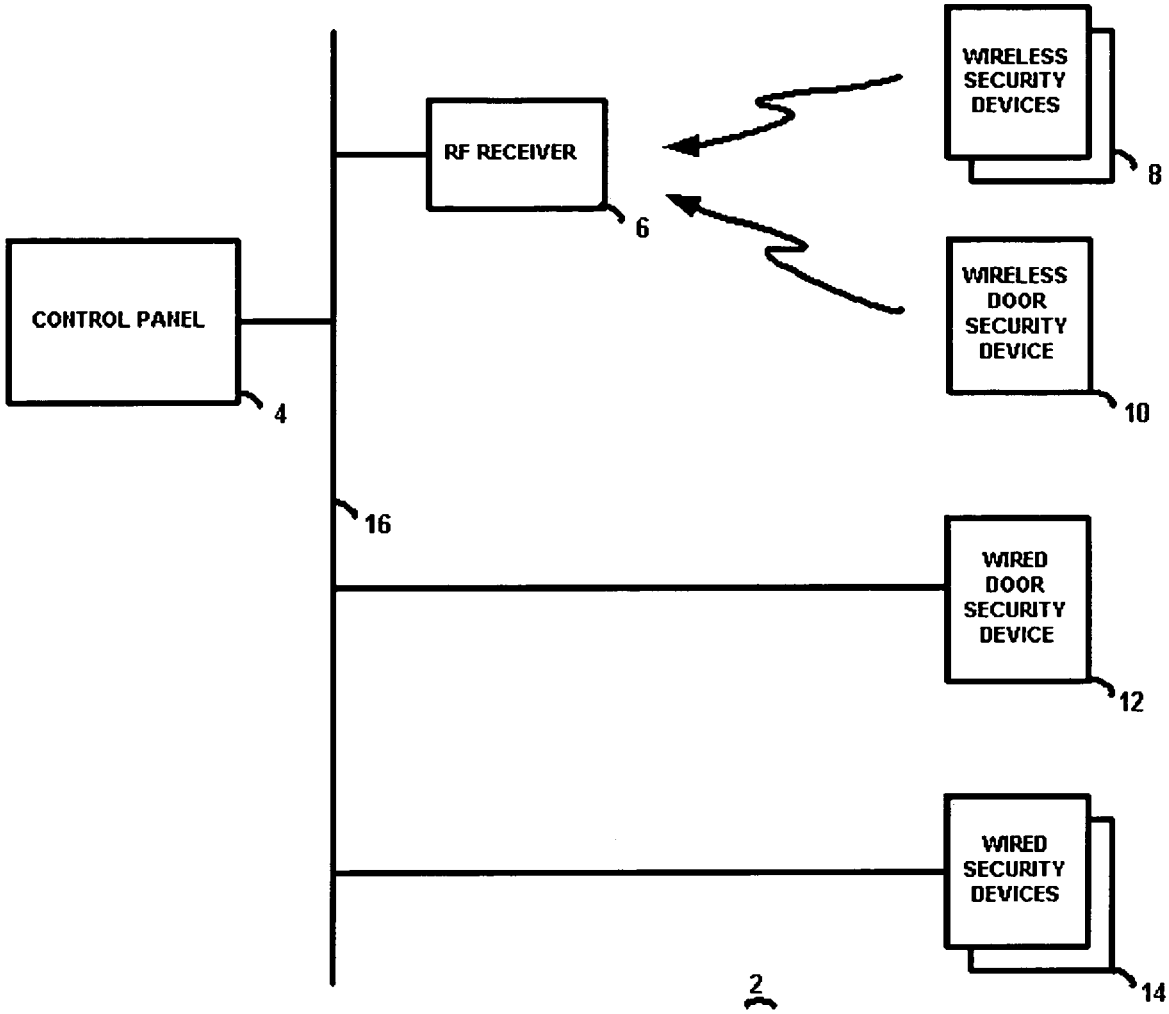
FIG. 1 illustrates a block diagram of a security system implementing the present invention.

The preferred embodiment of the present invention will now be described with respect to the Figures. FIG. 1 illustrates a block diagram of a security system 2 having a control panel 4 connected by a security system bus 16 to one or more wired security devices 14 as well known in the art. Security devices 14 may include, for example, a passive infrared (PIR) sensor for sensing motion of a protected volume of space, a smoke or heat detector, a glass break sensor, and the like. In addition, an RF receiver 6 is connected to the control panel 4, and provides wireless communications with wireless security devices 8 as well known in the art. These wireless security devices may also be PIR sensors, glass break sensors, etc. The control panel 4 operates as known in the art (except as modified in accordance with the present invention to interoperate with the door security devices described herein), including processing of alarm signals from the various security devices, arming the system, disarming the system, providing system status, etc.

Also shown in FIG. 1 are a wireless door security device 10 and a wired door security device 12, which differ only in the manner that they communicate with the control panel 4 (i.e. the wireless door security device communicates by wireless link to RF receiver 6 and the wired door security device communicates by wired bus 16). These devices will therefore be referred to generically as door security devices throughout this specification. A security system may have one door security device, or it may have a plurality of such devices, with each located strategically at a selected entry door of the premises being monitored.

Figure 1A:
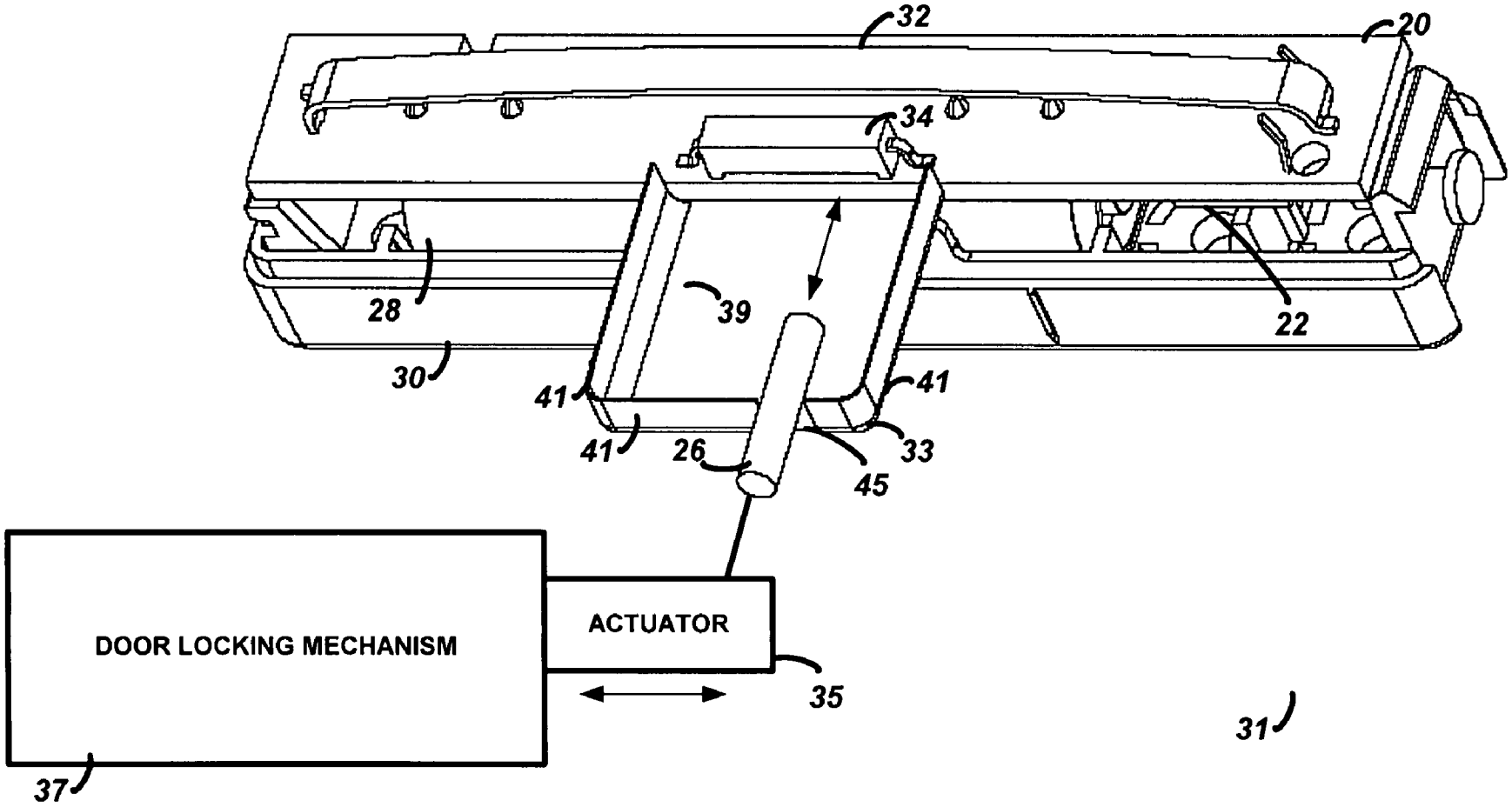
FIG. 1A is a perspective diagram of a lock position detection device of a preferred embodiment of the present invention.
Figure 1B:
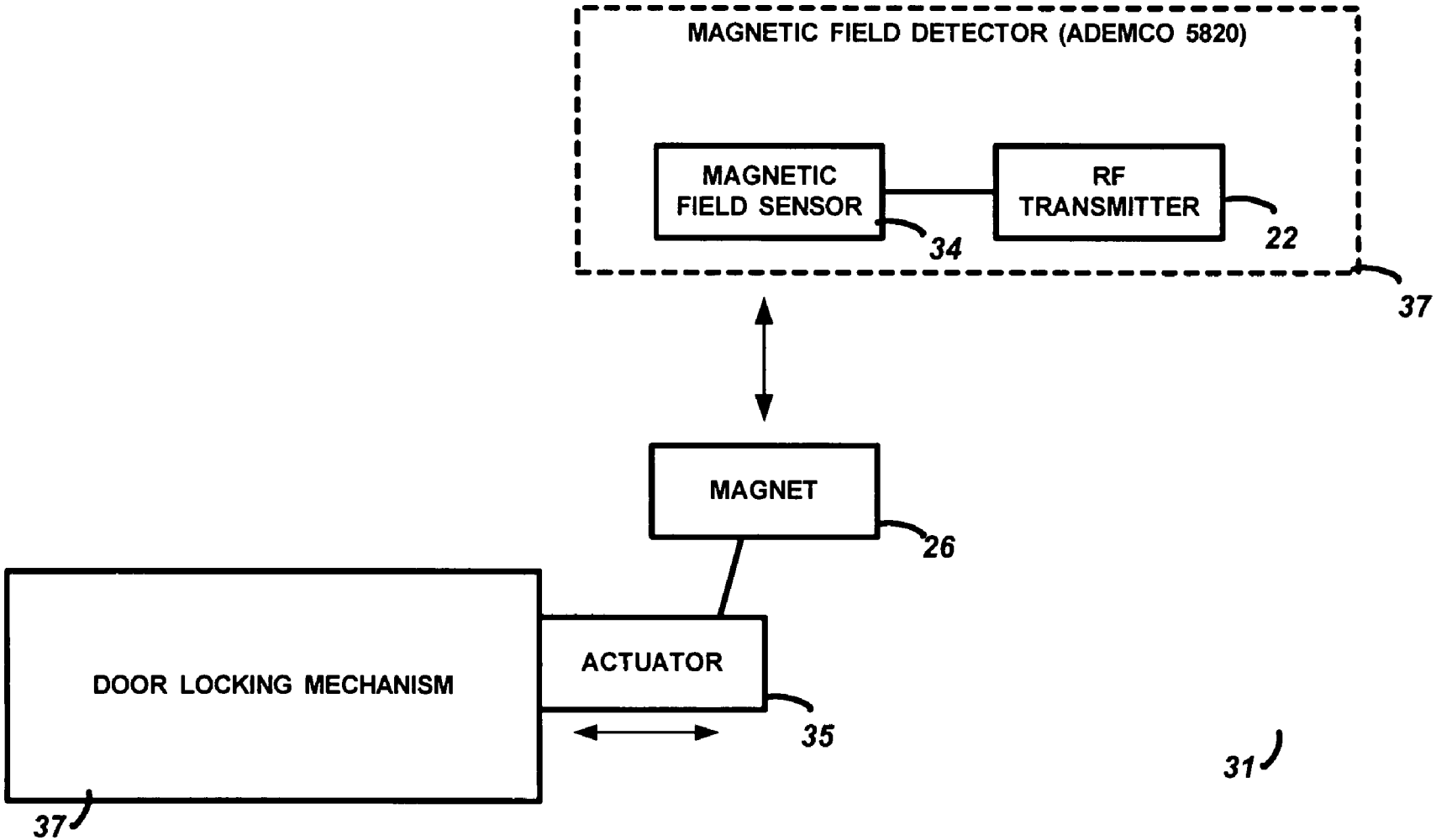
FIG. 1B is a block diagram of the device of FIG. 1A.

FIGS. 1A and 1B illustrate a preferred embodiment of the lock position detection device 31 of the present invention.

A magnetic field detection unit 37 comprises two main components; a magnetic field sensor 34 (such as a reed switch) and an RF transmitter 22. As further shown in FIG. 1A, the reed switch 34 and the RF transmitter 22 are mounted on a printed circuit board (PC board) 20, which is also used as a substrate for holding and connecting an antenna 32 and a battery 28. This PC board assembly 20 as described is contained inside a case 30. In the preferred embodiment, the case 30 and components contained therein (the PC board 20, the battery 28, the RF transmitter 22, the antenna 32, and the reed switch 34) are the HONEYWELL (ADEMCO) 5820 SLIMLINE DOOR/WINDOW CONTACT TRANSMITTER with part of the case 30 removed. Although this commercially available device is used in the preferred embodiment as described herein, other devices performing the same functionality as required by this invention may also be used accordingly. As known in the art, the 5820 device is designed for the RF transmitter 22 to transmit a signal indicating when a magnet enters proximity of the reed switch 34 (thus closing its internal contacts) and transmit an RF signal indicating when the magnet exits proximity of the reed switch (its internal contacts are open). The security system with which the 5820 device is connected (for example, as shown in FIG. 1) will interpret the signals from the 5820 device and act accordingly (e.g. sound an alarm, etc.) In addition, supervisory status signals are sent by the transmitter on a periodic basis (e.g. hourly) as well known in the art.

Figure 3A:
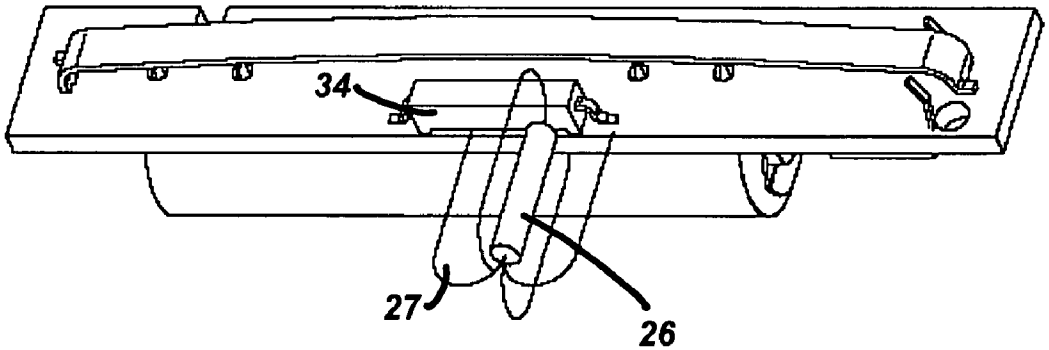
FIGS. 3A, 3B, and 3C are perspective, plan and side views, respectively, of the present invention without the magnetic shield, showing the magnetic field resulting therefrom.
Figure 3C:
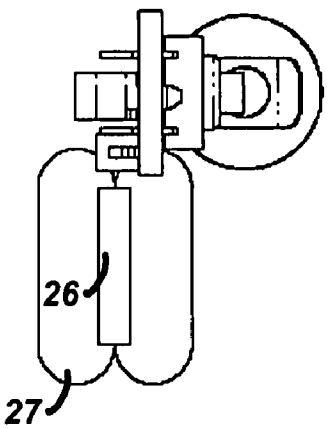
Figure 3B:
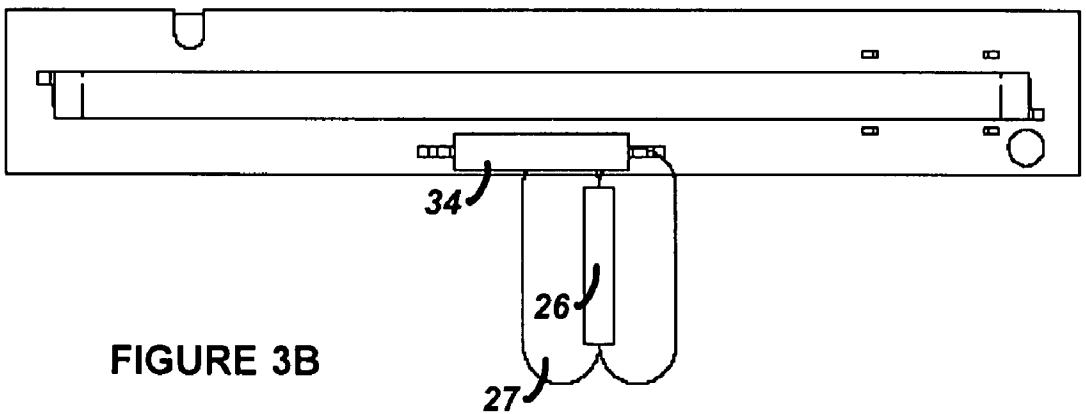

The present invention uses this 5820 device, or an equivalent, as a lock position detection device as follows. A magnet 26 is shown coupled to a door locking mechanism 33, in particular to an actuator 35 that is part of the door locking mechanism 33. Door locking mechanisms take various forms in the prior art and are well known. For example, a door locking mechanism may be a keyed deadbolt, a combination entry lock, etc. In any event, operation of the door locking mechanism will cause an actuator to travel between two positions (a closed position and an open position). By coupling the magnet 26 to the actuator 35 of the door locking mechanism 33, the magnet 26 is caused to travel between a first position and a second position accordingly. In one of these positions the magnet will enter proximity of the reed switch 34 and cause the RF transmitter 22 to transmit a first signal. In the other of these positions the magnet 26 will exit proximity of the reed switch 34 and cause the RF transmitter to transmit the second signal. FIGS. 3A, 3B and 3C illustrate the location of a magnet 26 with respect to the reed switch 34 such that the magnetic field 27 of the magnet is in proximity to the reed switch and causes the internal reed switch contacts (not shown) to close, such that the RF transmitter will transmit a signal to the security system.

Figure 2B:
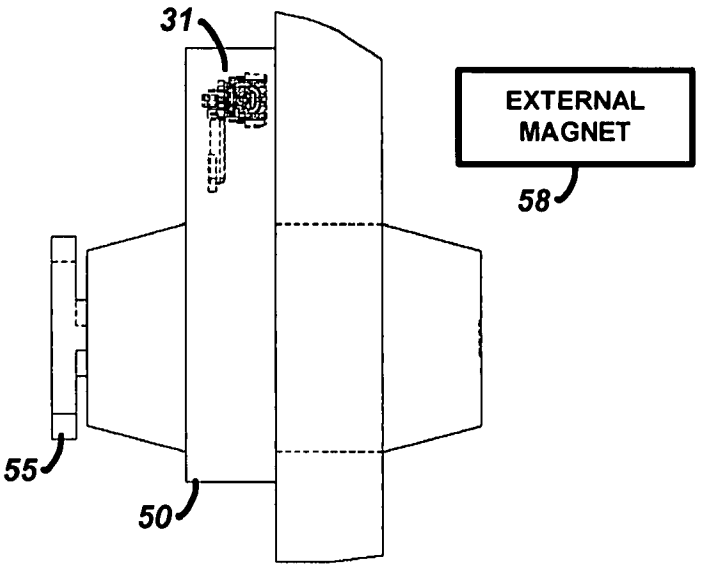
FIG. 2B is a closeup side view of the lock position detection device of FIG. 2A.
Figure 2A:
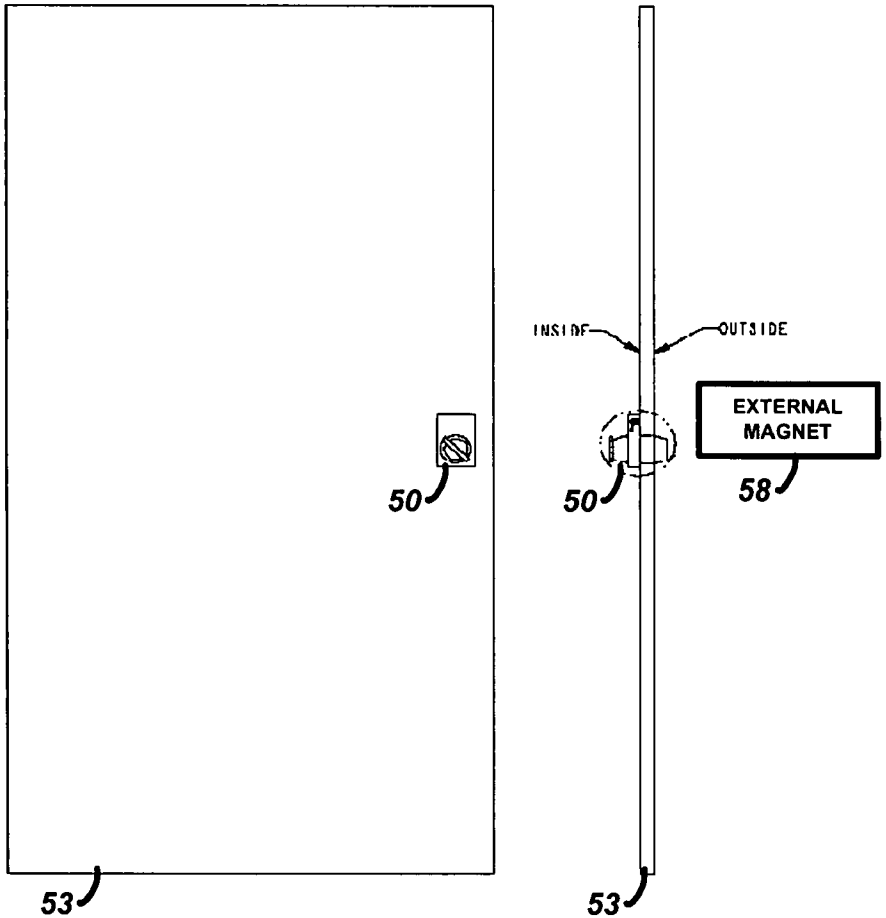
FIG. 2A is a plan and side view of a door with the lock position detection device mounted in a housing on an inside portion of a door.

FIGS. 2A and 2B illustrate the positioning of the lock position detection device 31 within a housing 50 that is attached to an interior side of a door 53 in one embodiment. Under normal operation, when the knob 55 is turned (or when a key is inserted into the outer portion of the lock and turned), then an actuator 35 is engaged that opens or closes the lock as previously described. In addition, the magnet 26 is coupled to the door locking mechanism 33, e.g. by being coupled to the actuator 35 directly or indirectly. The movement of the actuator 35 thus also causes the magnet 26 to travel towards the reed switch 34 or away from the reed switch 34, depending on the direction of the actuator. As the magnet 26 approaches the reed switch 34 such that the magnetic field 27 is detected by the reed switch 34, then the reed switch is activated and the RF transmitter 22 is caused to transmit a signal accordingly. Likewise, as the magnet travels away from the reed switch such that the magnetic field is no longer detected by the reed switch, then the reed switch is deactivated accordingly and the RF transmitter sends a corresponding signal.

As can be seen from the drawings, an intruder on the outside of the door 53 may be able to tamper with the lock position detection device 31 by placing an external magnet 58 near the door lock assembly such that the reed switch 34 remains activated even if the magnet 26 is caused to travel away from the reed switch (such as if, for example, the lock is mechanically picked from the outside). Since the external magnet 58 creates a magnetic field that keeps the reed switch closed, the system may be disarmed by the intruder.

Thus, the present invention implements a magnetic field shield 33 as shown in the Figures. The magnetic field shield 33 is located near the reed switch 34 as shown and, in the preferred embodiment, has an open-box shape including a flat end plate 39 and a plurality of sides 41. Although not visible from the Figures, the end plate may extend under the PC board 20 so as to provide additional shielding for the reed switch. The strategic location of the magnetic field shield will prevent a magnetic field originating from outside the door on the outside region from affecting the reed switch, but allow the magnetic field 27 created by the magnet 26 to interact with the reed switch as desired.

Figure 6:
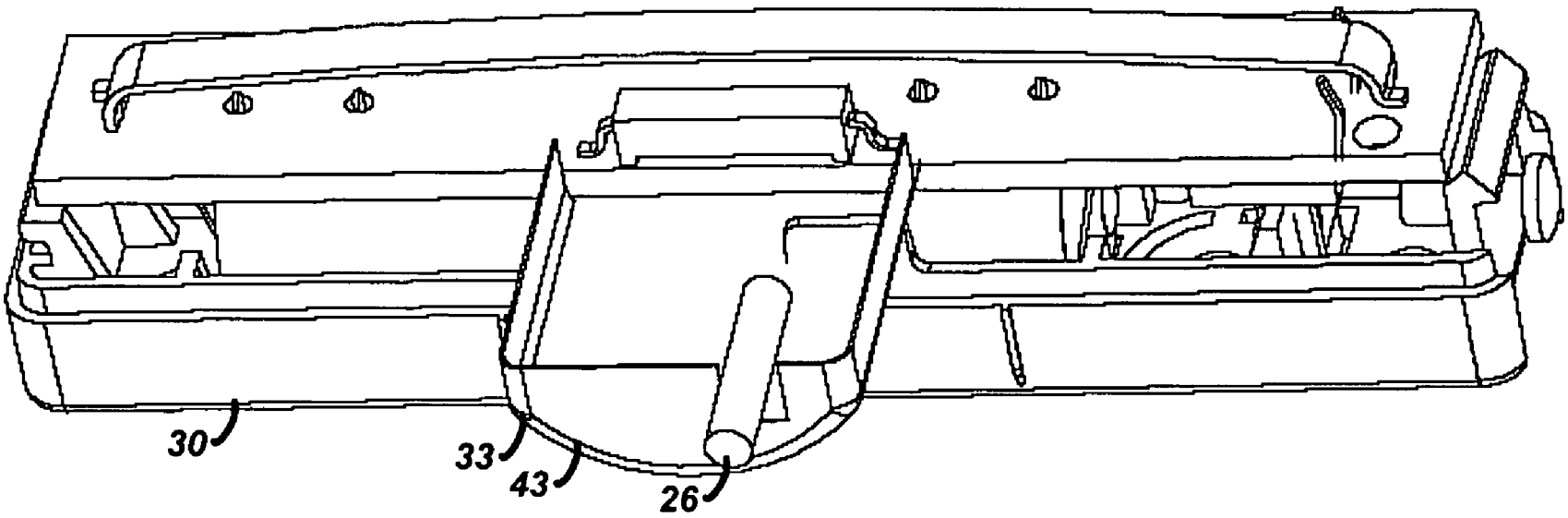
FIG. 6 is a perspective diagram of a lock position detection device of an alternative embodiment of the present invention.

The magnetic field shield 33 is made with a ferrous metal suitable for blocking the magnetic field generated by an external magnet as described above, and it may be formed out any suitable metal working process. Other shapes may be used for the magnetic field shield in addition to the open-box shape of the preferred embodiment. FIG. 6 illustrates an alternative embodiment in which the end plate is curved to provide a half-cylinder. Although this may be more difficult to fabricate, this may be advantageous since there would be less metal near the transmitter (and thus less transmission interference) and more uniform distance from the magnet to reduce the effect of the shield on the magnet 26.

Thus, as the magnet 26 travels along the path of travel as indicated in the figures, the reed switch 34 will detect the presence or absence of the magnetic field 27 generated by the magnet 26 since the shield 33 is open on the internal magnet side, thus allowing the desired interaction while inhibiting any magnetic field generated by an external magnet 58 on the outside region of the door 53 from affecting the reed switch 34.

Figure 5:
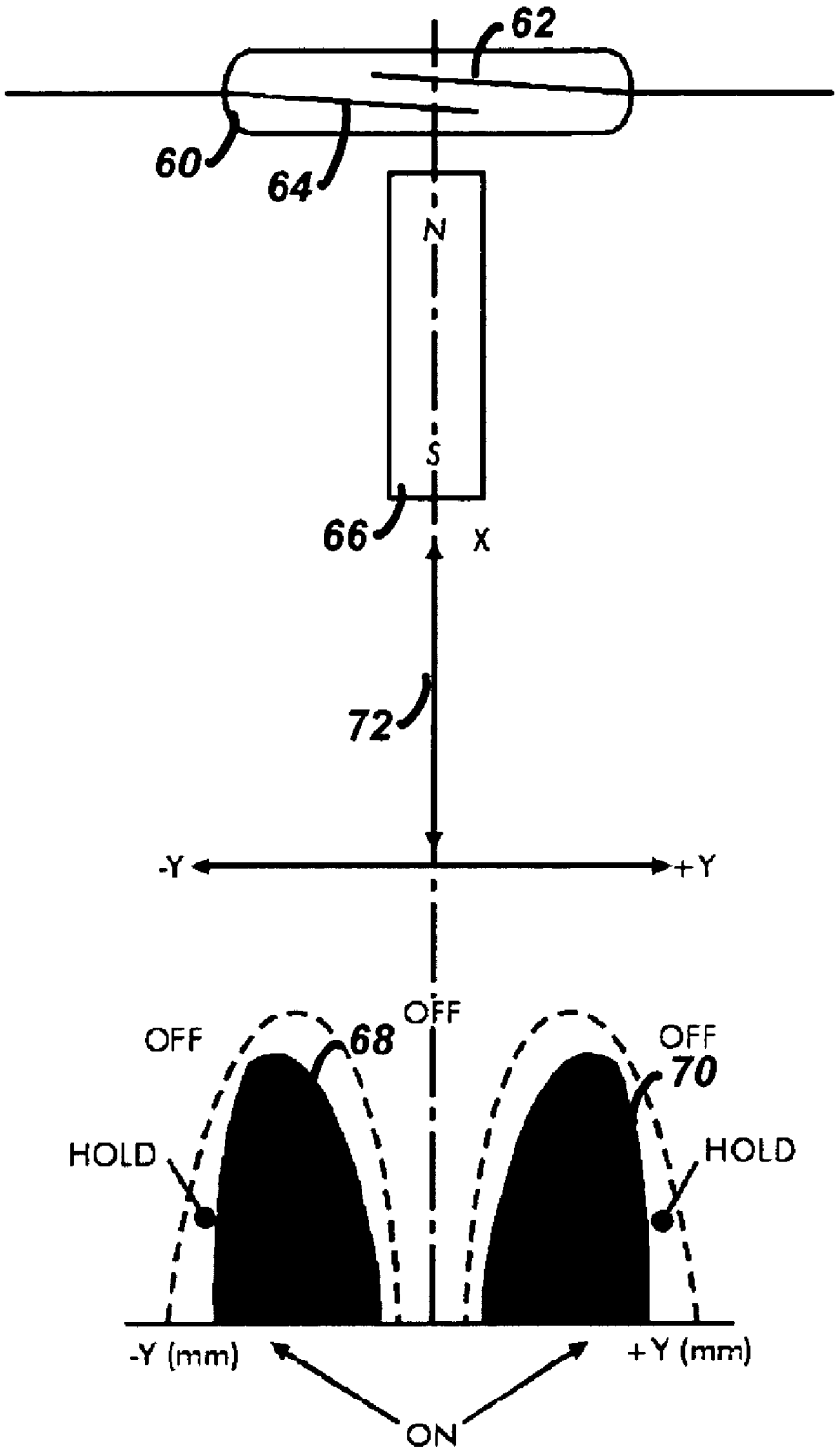
FIG. 5 is an illustration of a magnetic field that results from a magnet oriented perpendicularly with respect to a reed switch.

In a second aspect of the invention, the orientation of the magnet with respect to the reed switch is considered. FIG. 5 illustrates a reed switch 60 as known in the art, which has a pair of opposing contacts 62, 64 displaced from each other in a non-energized state. As a magnet 66 having a polar orientation as shown radiates a magnetic field as shown. In particular, in cross section view, a pair of lobes 68, 70 are generated that straddle the centerline 72 of the magnet 66 such that the magnetic field is actually stronger on either side of the centerline 72 rather than directly on the centerline. As the magnet travels along the centerline direction towards the reed switch 60, i.e. substantially perpendicular to the reed switch, then the magnetic field will eventually cause the reed switch contacts 62, 64 to be attracted towards each other and close the circuit, as known in the art. As can be seen from the drawing, it would be optimal to align the magnet 66 to be offset from the centerline 72 of the reed switch such that one of the side lobes 68, 70 will align with the centerline of the reed switch and cause the reed switch to close and open in a much more robust fashion, accordingly.

Figure 4A:
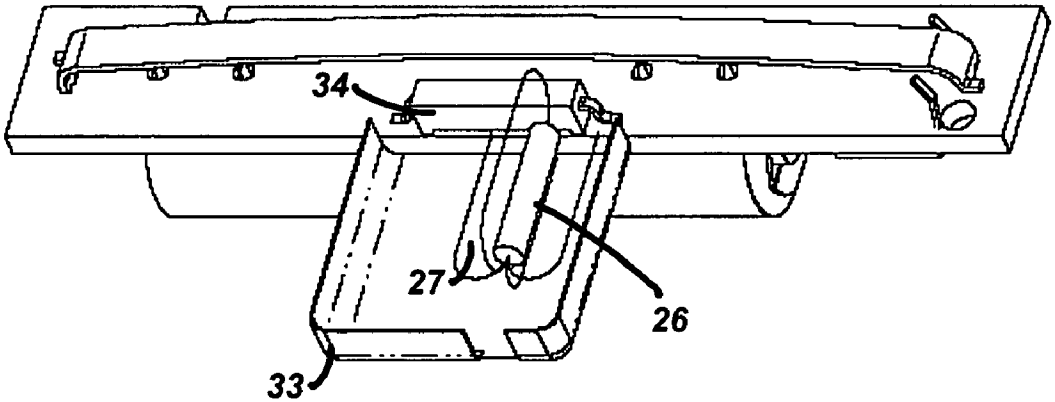
FIGS. 4A, 4B, and 4C are perspective, plan and side views, respectively, of the present invention with the magnetic shield, showing the magnetic field resulting therefrom.
Figure 4C:
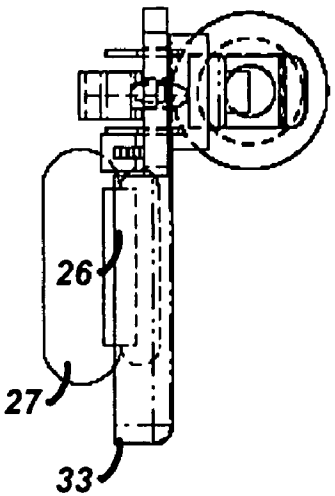
Figure 4B:
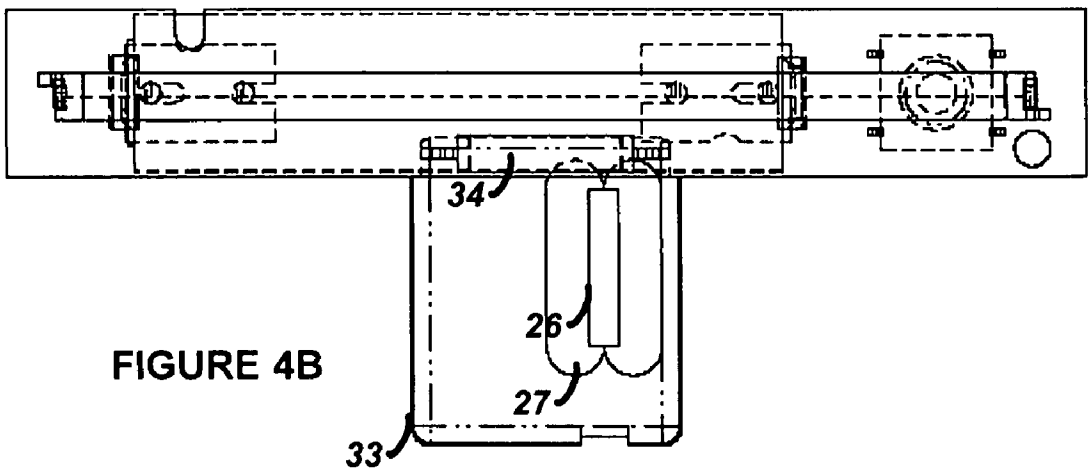

Thus, as shown in FIGS. 4A-4C, the centerline of the magnet is aligned offset from the centerline of the reed switch as it approaches the reed switch in a generally perpendicular manner. As the magnetic field 27 approaches the reed switch 34, it will cause the reed switch to activate as described herein, and as the magnet travels away from the reed switch it will cause the reed switch to deactivate accordingly. It is noted that the polarity (north/south) of the magnet may be reversed with no effect on the invention herein.

The lock position detection device of the present invention may be implemented in a retrofit application for existing doors. In one aspect, the lock position detection device may be installed within an existing door locking structure by mounting the magnetic field detection unit (the case along with its constituent components) in an existing void within a door in proximity to the existing (or a replacement) locking mechanism. A magnet would then be installed so as to be operative with respect to an actuator of the lock mechanism so as to interact with the reed switch as described herein. In addition, the magnetic field shield would be added so as to provide protection from a magnetic field emanating from the outside of the door as previously described. Likewise, the lock position detection device may be encased in a housing and placed on the interior side of the door as shown in FIGS. 2A and 2B. Moreover, the lock position detection device may be adapted to be include din a door whereby the door would be purchased and installed as a complete security solution in new or existing construction.

Figure 7:
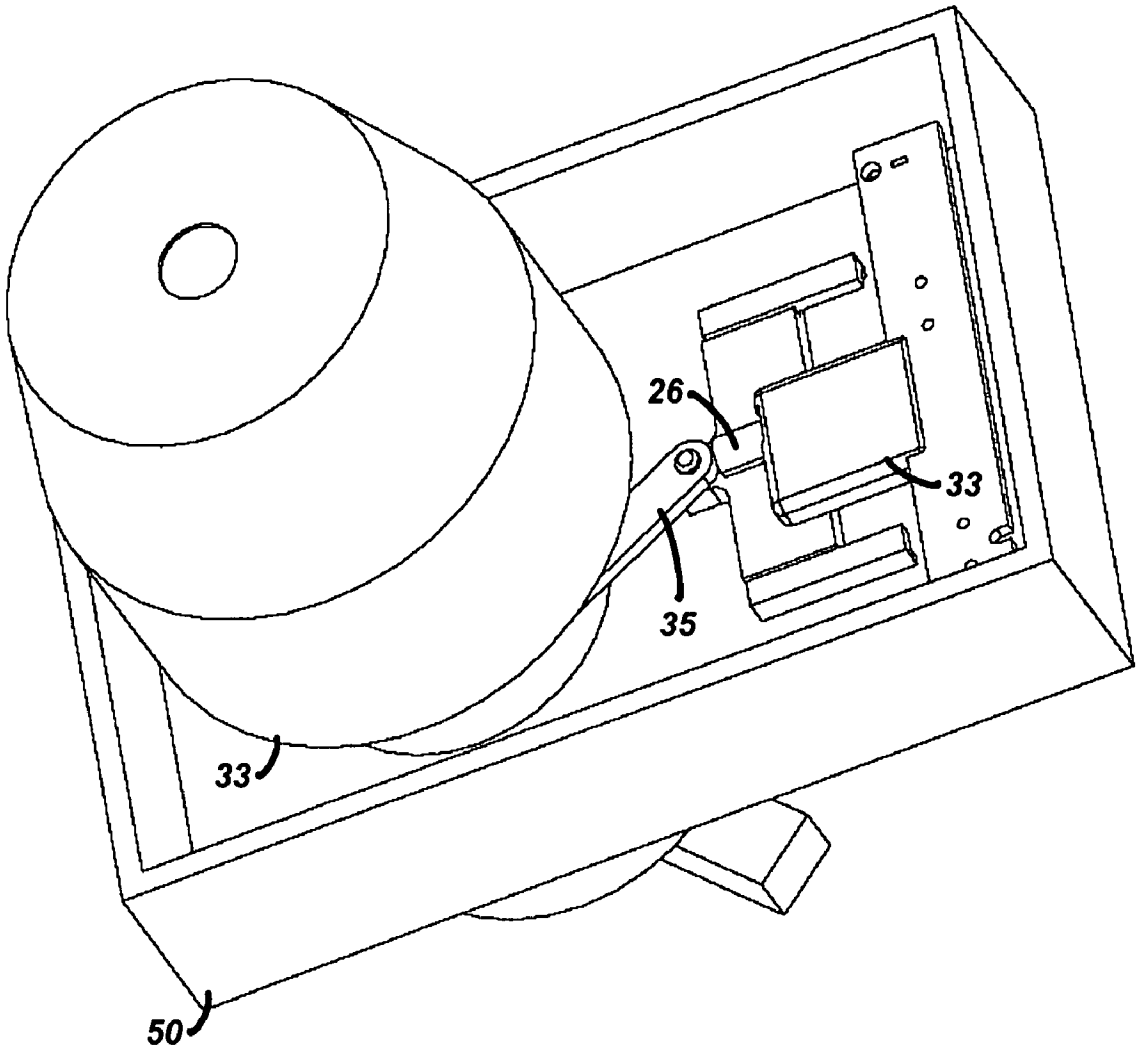
FIG. 7 illustrates a perspective view of an exemplary mounting of the present invention in a housing.

FIG. 7 illustrates a perspective view of an exemplary mounting of the present invention in a housing 50. Shown is an actuator 35 which is linked to the door locking mechanism, e.g. by a linear or cam mechanism use within the door locking mechanism as known in the art. As previously described, the actuator is caused to travel between two positions (corresponding to the locked and unlocked states of the lock) and the magnet 26 travels towards and away from the reed switch accordingly (in FIG. 7 the shield 33 covers the reed switch as described previously).

What is claimed is:

1. A lock position detection device adapted to be mounted on a door, for securing entry from an outside region of the door to an inside region of the door, the lock position detection device comprising:

a. a door locking mechanism comprising an actuator operable so as to be in a first position or a second position, the first position causing the door locking mechanism to lock the door and the second position causing the door locking mechanism to unlock the door;

b. a magnetic field detection unit comprising i. a magnetic field sensor adapted to output a first signal when the magnetic field sensor detects a magnetic field and a second signal when the magnetic field sensor does not detect a magnetic field;

ii. a wireless transmitter coupled to the magnetic field sensor for transmitting a radio frequency signal based on signals received from the magnetic field sensor;

c. a magnet coupled to the door locking mechanism such that the magnet i. enters proximity of the magnetic field sensor when the actuator is operated to one of the first position or the second position and causes the magnetic field sensor to output the first signal; and ii. exits proximity of the magnetic field sensor when the actuator is operated to the other of the first position or the second position and causes the magnetic field sensor to output the second signal; and d. a magnetic field shield located with respect to the magnetic field sensor so as to prevent a magnetic field originating from the outside region of the door from being detected by the magnetic field sensor;

wherein the magnetic field sensor is a reed switch and wherein the magnet enters and exits proximity of the reed switch substantially along a line that is offset from a centerline of the reed switch.

2. The lock position detection device of claim 1 wherein the magnetic field shield comprises a ferrous metal.

3. The lock position detection device of claim 1 wherein the magnetic field shield comprises a flat end plate and a plurality of sides attached to the end plate so as to form an open-box shape, wherein the end plate is located to as to substantially shield the magnetic field sensor from a magnetic field originating from the outside region of the door.

4. The lock position detection device of claim 1 wherein the magnetic field shield comprises a curved end plate and a plurality of sides attached to the end plate so as to form a partial cylindrical shape, wherein the end plate is located to as to substantially shield the magnetic field sensor from a magnetic field originating from the outside region of the door.

5. The lock position detection device of claim 1 wherein the magnet is coupled to the door locking mechanism such that the magnet enters proximity of the magnetic field sensor at an angle generally perpendicular to the magnetic field sensor when the actuator is operated to one of the first position or the second position and exits proximity of the magnetic field sensor at an angle generally perpendicular to the magnetic field sensor when the actuator is operated to the other of the first position or the second position.

6. The lock position detection device of claim 1 further comprising a housing for substantially enclosing the lock position detection device, wherein the housing is adapted to mount on an inside surface of the door facing the inside region of the door.

7. A combination door and lock position detection device comprising the lock position detection device of claim 1 and a door within which the lock position detection device is substantially enclosed.

8. The lock position detection device of claim 1 wherein the actuator is operable by entry of a key by a user.

9. The lock position detection device of claim 1 wherein the actuator is operable by a knob accessible to a user.

10. The lock position detection device of claim 1 wherein the magnetic field sensor is a reed switch.

11. A lock position detection device adapted to be mounted on a door, for securing entry from an outside region of the door to an inside region of the door, the lock position detection device comprising:

a. a door locking mechanism comprising an actuator operable so as to be in a first position or a second position, the first position causing the door locking mechanism to lock the door and the second position causing the door locking mechanism to unlock the door;

b. a magnetic field detection unit comprising i. a magnetic field sensor adapted to output a first signal when the magnetic field sensor detects a magnetic field and a second signal when the magnetic field sensor does not detect a magnetic field;

ii. a wireless transmitter coupled to the magnetic field sensor for transmitting a radio frequency signal based on signals received from the magnetic field sensor; and c. a magnet coupled to the door locking mechanism such that the magnet i. enters proximity of the magnetic field sensor at an angle generally perpendicular to the magnetic field sensor when the actuator is operated to one of the first position or the second position and causes the magnetic field sensor to output the first signal; and ii. exits proximity of the magnetic field sensor at an angle generally perpendicular to the magnetic field sensor when the actuator is operated to the other of the first position or the second position and causes the magnetic field sensor to output the second signal; wherein the magnetic field sensor is a reed switch and wherein the magnet enters and exits proximity of the reed switch substantially along a line that is offset from a centerline of the reed switch.

12. The lock position detection device of claim 11 further comprising a housing for substantially enclosing the lock position detection device, wherein the housing is adapted to mount on an inside surface of the door facing the inside region of the door.

13. A combination door and lock position detection device comprising the lock position detection device of claim 11 and a door within which the lock position detection device is substantially enclosed.

14. The lock position detection device of claim 11 wherein the actuator is operable by entry of a key by a user.

15. The lock position detection device of claim 11 wherein the actuator is operable by a knob accessible to a user.

* * * * *